US006329583B1

(12) United States Patent
May

(10) Patent No.: US 6,329,583 B1
(45) Date of Patent: Dec. 11, 2001

(54) CARRIER ASSEMBLY FOR PERCUSSION INSTRUMENTS

(76) Inventor: Randall L. May, 8 Windsor, Newport Beach, CA (US) 92660

( * ) Notice: Subject to any disclaimer, the term of this patent is extended or adjusted under 35 U.S.C. 154(b) by 0 days.

(21) Appl. No.: 09/497,266

(22) Filed: Feb. 3, 2000

Related U.S. Application Data

(60) Division of application No. 08/976,999, filed on Sep. 24, 1997, now Pat. No. 6,028,257, which is a continuation-in-part of application No. 08/588,244, filed on Jan. 18, 1996, now Pat. No. 5,691,492.

(51) Int. Cl.[7] ..... G10D 13/02

(52) U.S. Cl. ..... 84/421; 84/411 R; 84/327; 248/443; 248/444

(58) Field of Search ..... 84/411 R, 421, 84/453, 327; 248/443, 444

(56) References Cited

U.S. PATENT DOCUMENTS 4,799,610 * 1/1989 Hsieh ..... 84/421
5,400,683 * 3/1995 LaFlame ..... 84/421
5,573,158 * 11/1996 Penn ..... 84/421
5,973,247 * 10/1999 Matthews ..... 84/421

OTHER PUBLICATIONS

Wexler "Complete Catalog of Musical Merchandise" Rapid Index Catalog No. 6, David Wexler & Co., copyright 1965.*

* cited by examiner

*Primary Examiner*—Marlon T. Fletcher
(74) *Attorney, Agent, or Firm*—Neal J. Mosely

(57) ABSTRACT

Drum hardware and drum secured thereon are preferably supported on a vest type carrier or a T-bar carrier having a plurality of separate parts removable from each other and formed of a rigid light metal such as magnesium, aluminum or titanium. Special padding is provided on the shoulder straps, belly plate portion and other parts where cushioning is needed. The hardware may be universally adjustable and removable.

8 Claims, 5 Drawing Sheets

CARRIER ASSEMBLY FOR PERCUSSION INSTRUMENTS

CROSS REFERENCE TO RELATED APPLICATION

This application is a division of applicant's application Ser. No. 08/976,999, allowed Sep. 24, 1997 now U.S. Pat. No. 6,028,257, which is a continuation-in-part of applicant's application Ser. No. 08/588,244, filed Jan. 18, 1996 now U.S. Pat. No. 5,691,492, issued Nov. 25, 1997.

BACKGROUND OF THE INVENTION

1. Field of the Invention

This invention relates to new and useful improvements in apparatus for carrying percussion instruments, particularly drums of various kinds, cymbals, xylophones, and the like. More particularly, the present invention relates to a carrier hardware providing a novel support for percussion instruments and to carrier assemblies supporting percussion instruments on a person while standing, walking or marching. The carrier assembly has a construction and relationship of parts to transfer the weight of the percussion instrument (s) to the body of a person carrying the same to maintain a stable attitude while walking or marching about and avoid pressure or other forms of detrimental forces on the shoulders and lower back and is further characterized by having removable and/or adjustable shoulder straps.

2. Brief Description of the Prior Art

The prior art discloses many examples of apparatus for supporting percussion instruments but none providing the combination of features disclosed and claimed herein.

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back pressure plate and wrap about shoulders and support straps connect to the abdominal plate which has suitable fixtures for attachment of various percussion instruments.

Hsieh U.S. Pat. No. 4,799,610 shows a carrier for percussion instruments having a "T" bar, a pair of shoulder bars, a belly plate. The shoulder bars are bolted on a lateral plate of the "T" bar. The lateral plate has arc-like slots and spaced semi-circular holes permit bolts to slide in the slots. The fastening end of each shoulder bar has a hole and an arc-like slot from the upper portion to the lower portion permitting angular adjustment of the shoulder rightward or leftward for various applications. The carrier holder is applied to carrying a bass drum fastened by J-bars.

La Flame U.S. Pat. No. 4,643,032 shows a carrier for various instruments such as marching bells, a marching xylophone or a marching marimba, which are sup-ported on the apparatus by the use of suitably-constructed extension arms. The carrier frame is a U-shaped bent bar welded or otherwise attached to a belly plate and has extension arms which project from the belly plate to engage and support the instrument.

La Flame U.S. Pat. No. 4,605,144 shows an instrument carrier with a forward-projecting frame portion having a drum mounting assembly. The mounting assembly has adjustable clamp jaw elements with curved surfaces which conform to the cylindrical wall of a drum. In practice, the wall of the drum is sandwiched between the jaw elements and the assembly is secured in clamping engagement on the drum side wall by mechanical fasteners such as a pair of screw and nut sets which are passed through bores in the clamp elements and drawn tight to securely clamp the drum wall The mounting assembly may be mounted on the side wall of drum between the drum heads or, alternatively, on a portion of the wall or a rim which projects outwardly of the drum head.

Dranchak U.S. Pat. No. 4,387,839 discloses a drum-supporting harness having two shoulder hooks with cushion pads or liners, a breast plate secured to the hooks, and a hanger structure attached to the breast plate and depending therefrom. Carried by the lower portion of the hanger structure are upwardly-facing hooks, a spacer bar extending downward from the hooks, and a spacing abutment carried by the spacer bar and extending forwardly therefrom. The hooks and the spacing abutment engage upper and lower portions of the body of the drum. The hanger structure is adjustable or extensible by means of overlapping strips which can be secured in a number of different positions. An adapter assembly attaches to the upper rim portion of the drum for connecting of hooks to the drum.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person, a rigid band with a generally bent contour to extend along a portion of the waistline area of the person to the back of the person, a back-plate riser arm supported by the ban to extend in a generally upward direction such that a portion of the arm will extend along the back thoracic region of the person, and means carried by the arm for imparting to the thoracic back region of the person a reactive force to the overhung weight of the instrument about the aforesaid means forming a fulcrum area of contact with the person.

Other possibly relevant prior art is Pyle U.S. Pat. No. 5,054,357; May U.S. Pat. No. 5,072,910 and May U.S. Pat. No. 5,300,810.

SUMMARY OF THE INVENTION

One object of the invention is to provide a new and improved carrier for percussion instruments, e.g., a snare drum, having hardware for supporting a drum having removable shoulder straps.

Another object of the invention is to provide a new and improved carrier for percussion instruments comprising a novel supporting vest with removable shoulder straps.

Another object of the invention is to provide a new and improved carrier for percussion instruments comprising a novel supporting vest of composite material (Fiberglas), rigid removable shoulder straps of light metal, and back bar of light metal such as aluminum, magnesium, etc.

Another object of the invention is to provide a new and improved carrier for percussion instruments comprising a novel T-bar carrier with a belly plate, removable shoulder straps, and back bar of light metal such as aluminum, magnesium, etc.

Another object of the invention is to provide a new and improved carrier for percussion instruments comprising a novel T-bar carrier with belly plate, removable shoulder straps, and back bar of light metal such as aluminum, magnesium, etc. the shoulder straps being of two parts slidably fitted together for adjustment.

Another object of the invention is to provide a new and improved carrier for percussion instruments comprising a novel T-bar carrier with belly plate, removable shoulder straps, and back bar of light metal such as aluminum, magnesium with J-bars mounted on the carrier for supporting cymbals or other percussion instruments.

Another object of the invention is to provide a new and improved carrier for percussion instruments comprising a novel T-bar carrier having a construction permitting almost universal adjustment of the points of attachment and location of the percussion instruments and including removable shoulder straps.

Another object of the invention is to provide a new and improved carrier for percussion instruments, particularly marching hardware, a construction permitting almost universal adjustment of the points of attachment and location of the percussion instruments and further having adjustable connections for the shoulder straps permitting removal and replacement and longitudinal and angular adjustment.

Other objects of the invention will become apparent throughout the specification and claims as hereinafter related.

DESCRIPTION OF THE PREFERRED EMBODIMENTS

Marching Vest Support for Drums and Other Percussion Instruments

Figure 1:
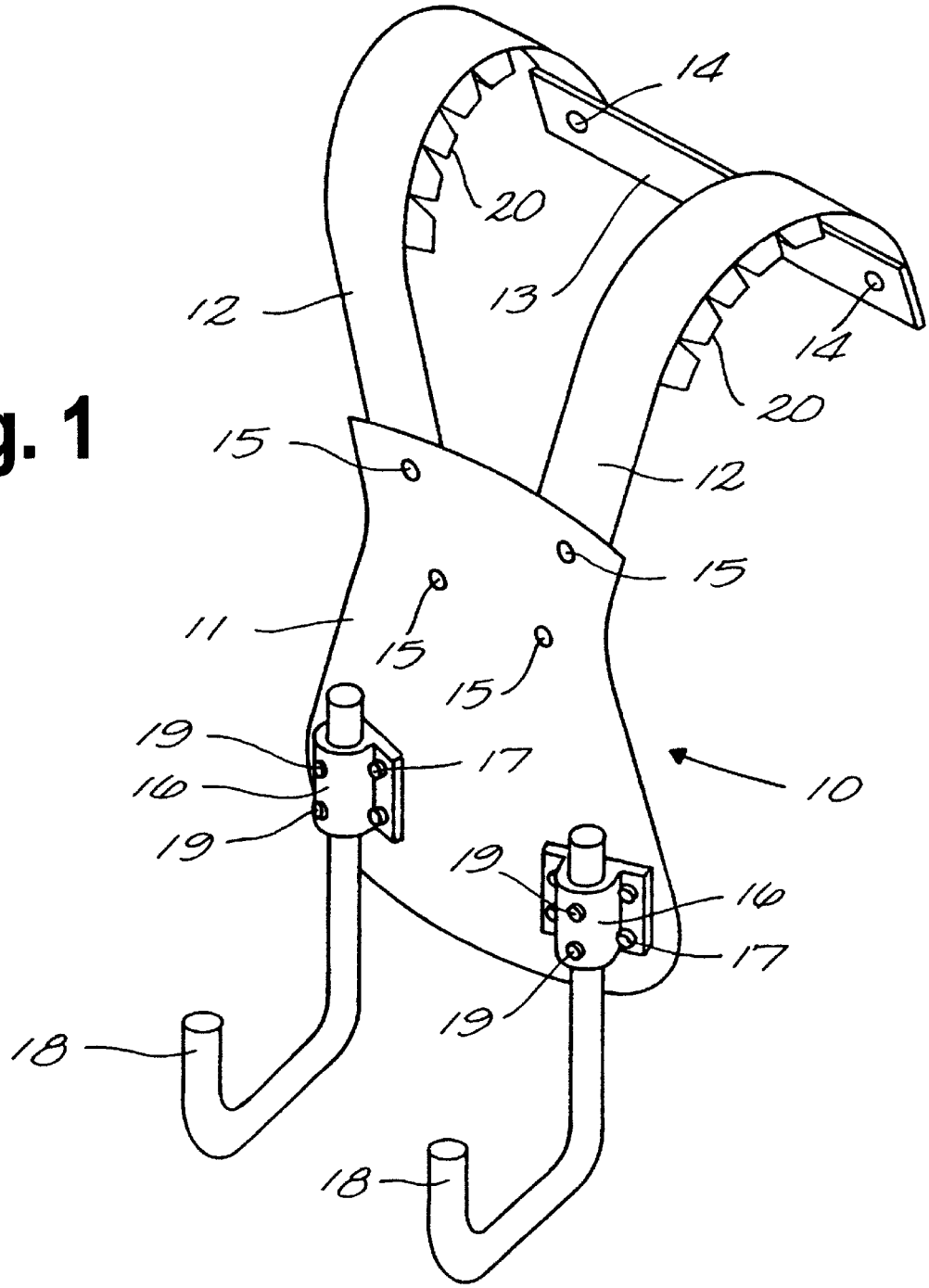
FIG. 1 is an isometric view of a novel supporting vest for marching drum assemblies with removable shoulder straps.

Referring to FIG. 1, there is shown a vest- or harness-type 10 carrier for percussion instruments which comprises a vest portion 11, shoulder straps 12 and back bar 13. Back bar 13 is removably secured to shoulder straps 12 by screws or bolts 14. Back bar 13 may be fixed as by welding or the like. Vest portion 11 is removably secured to shoulder straps 12 by screws or bolts 15 and has a pair of J-rod receptacles 16 secured by screws or bolts 17. J-rods 18 are supported in receptacles 16 and secured in position by T-bolts or set screws 19. Shoulder straps 12 have cushions or pads 20 to cushion the load of the instruments carried by carrier 10.

The materials of construction used in this carrier 10 are very important for achieving the desired result. The vest portion 11 is preferably a strong, lightweight metal or composite material such as Fiberglas®. Back bar 13 and shoulder straps 12 are rigid and made of a light metal such as aluminum, magnesium or titanium. Some prior art vests of this type have been of a one-piece Fiberglas® construction. There were incidents of failure of the shoulder straps from repeated flexing. The metal shoulder straps do not fail in flexure and also have the advantage that they may be removed and different sizes are readily installed. The vest portion 11 can be of a single size and separate shoulder straps 12 of differing radii for small, medium, large or extra large size.

The cushions 20 are of a type used to pad the interior of football and other sports helmets. Cushions have a backing strip of polyvinyl plastic film. A thin sheet of polyvinyl film encloses blocks of closed pore plastic (e.g., polystyrene or polyurethane) foam and is sealed to the backing strip to enclose separate blocks. The blocks are separately compressible and provide more comfort to the wearer of the carrier when fully loaded. Shoulder straps 12 may be adjustable as in other embodiments below.

Operation

The operation of this carrier should be apparent but will be described briefly for clarity. The carrier 10 is worn by the musician with the shoulder straps 12 positioned over the shoulders and the vest 11 supported against his abdomen. Pads 20 on shoulder straps 12 cushion the load of the instruments carried by carrier 10. Pads 20 may also be used in padding back bar 13 or vest belly plate portion 11.

Vest 11 may have suitable padding over its inner surface, as needed, to avoid discomfort from the bolts or screws 15 used to assemble the straps to the vest or bolts or screws 17 used to assemble receptacles 16 on the vest. Back bar 13 may be removed or omitted for the convenience of drummers who prefer an open back. J-rods 18 are inserted in position and secured in place by tightening set screws 19. The short outer ends of the J-rods are inserted into the J-rod receptacles on the percussion instrument being carried, e.g., drums (single or array), cymbals, xylophone, marimba, or the like.

Figure 2:
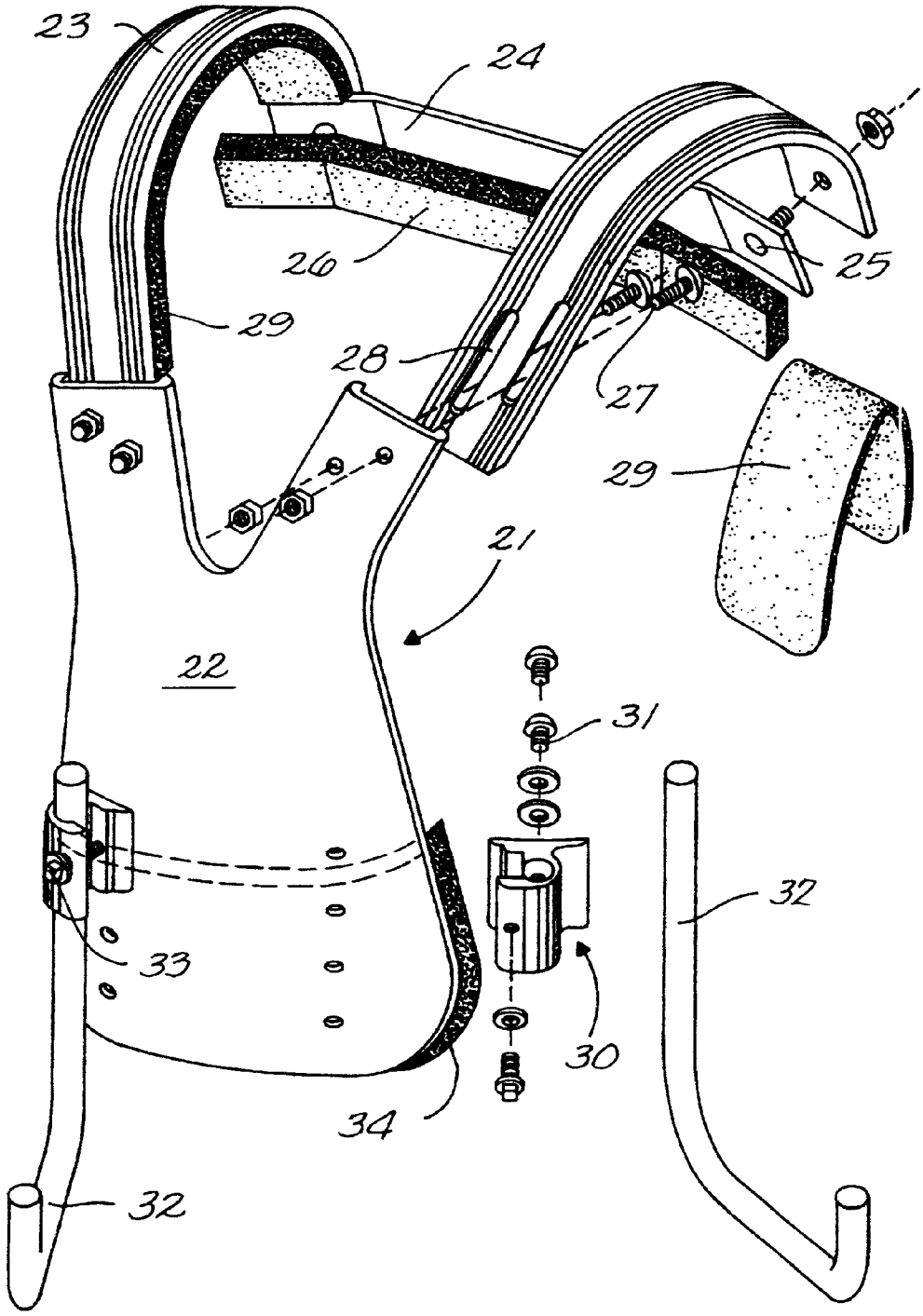
FIG. 2 is an exploded, isometric view of a novel supporting vest for marching drum assemblies, as in FIG. 1, which is constructed to permit removal and replacement or adjustment of the shoulder straps and the J-rods.

Another Embodiment of Adjustable Marching Vest Support for Drums and Other Percussion Instruments Referring to FIG. 2, there is shown a vest- or harness-type carrier 21 for percussion instruments, which comprises a vest portion 22, shoulder straps 23 and back bar 24. Back bar 24 is removably secured to shoulder straps 23 by screws or bolts 25 and has padding 26. Vest portion 22 is adjustably and removably secured to shoulder straps 23 by screws or bolts 27 which extend through elongated slots 28 which permits adjustment of the straps 23 relative to vest portion 22. Shoulder straps 23 have pads 29 to cushion the load of the instruments carried by carrier 21.

Vest portion 22 has a pair of J-rod receptacles 30 secured by screws or bolts 31. J-rods 32 are supported in receptacles 30 and secured in position by square head bolts 33 which may be operated by a drum key (not shown). Receptacles 30 are cast or extruded and have an open edge portion which can flex to clamp J-rods 32 adjustably. Receptacles 30 have an inner surface that is polygonal, in this case, hexagonal, in section which provides a plurality (in this case five) of surfaces which clamp the surface of the J-rods 32. This is a superior clamping arrangement to set screws that provide only one or two point clamping contract. Holes in the base of each receptacle 30 are used for mounting by means of bolts or screws or the like. Aligned holes receive clamping screws 33 which operate on adjustment to clamp or to release the J-rods 32.

The materials of construction used in this carrier 21 are very important for achieving the desired result. The vest portion 22 is preferably a strong, lightweight metal or a composite material such as Fiberglas®. Back bar 24 and shoulder straps 23 are rigid and made of a light metal such as aluminum, magnesium or titanium. Some prior art vests of this type have been of a one-piece Fiberglas® construction. There were incidents of failure of the shoulder straps from repeated flexing. The metal shoulder straps do not fail in flexure and also have the advantage that different sizes are readily accommodated. The vest portion 22 can be of a single size and separate shoulder straps 23 of differing radii for small, medium, large or extra large size may be used or the straps 23 may be adjustable. The cushions 29 may be of a type used to pad the interior of football and other sports helmets as previously described.

Operation

The operation of this carrier should be apparent but will be described briefly for clarity. The carrier 21 is worn by the musician with the shoulder straps 23 positioned over the shoulders and the vest 22 supported against his abdomen. Pads 29 and 26 on shoulder straps 23 and back bar 24 cushion the load of the instruments carried by carrier 21. The straps 23 are adjustable by means of slots 28 and screws 27 and the J-rods 32 are adjustable in position by means of receptacles 30 and adjustment screws 31, 33.

Vest 22 may have suitable padding 34 over its inner surface, as needed, at the belly plate or at suitable locations to avoid discomfort from the bolts or screws used to assemble the straps to the vest or bolts or screws used to assemble receptacles 30 on the vest. J-rods 32 are inserted in position and secured in place by tightening set screws 33. The short outer ends of the J-rods are inserted into the J-rod receptacles on the percussion instrument being carried, e.g., drums (single or array), cymbals, xylophone, marimba, or the like.

Figure 3:
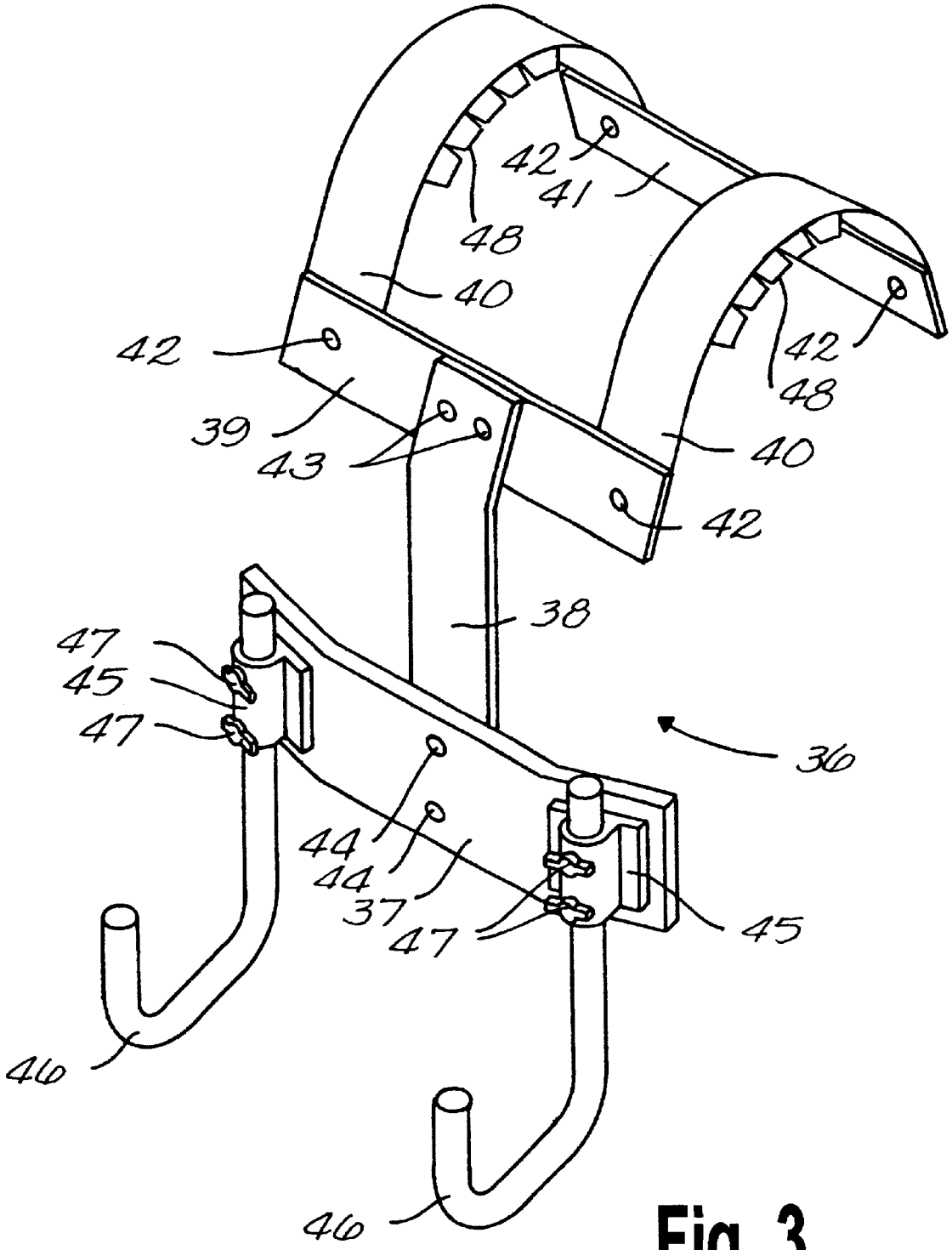
FIG. 3 is an isometric view of a novel T-bar assembly for supporting drums containing features of the supporting vest of FIG. 1 for marching drum.

Another Embodiment Marching T-bar Support for Drums and Other Percussion Instruments Referring to FIG. 3, there is shown a T-bar-type carrier 36 for percussion instruments which comprises a belly plate 37, vertical bar 38, upper horizontal bar 39, shoulder straps 40 and back bar 41. Back bar 41 is removably secured to shoulder straps 40 by screws or bolts 42. Where desired, back bar 41 may be fixed as by welding or the like. Upper horizontal bar 39 is removably secured to shoulder straps 40 by screws or bolts 42. Upper horizontal bar 39 is removably secured to the upper end of vertical bar 38 by screws or bolts 43.

Belly plate 37 is removably secured to the lower end of vertical bar 38 by screws or bolts 44. A pair of J-rod receptacles 45 are secured on belly plate 37 by screws or bolts or the like. J-rods 46 are supported in receptacles 45 and secured in position by T-bolts 47. Shoulder straps 40 have pads 48 to cushion the load of the instruments carried by T-bar carrier 36. Pads 48 may also be used in padding back bar 41 or vest belly plate portion 37.

The materials of construction used in this carrier 36 are very important for achieving the desired result. The belly plate 37, vertical bar 38, upper horizontal bar 39, shoulder straps 40 and back bar 41 are rigid and made of a light metal such as aluminum, magnesium or titanium. The metal shoulder straps have the advantage that different sizes are readily accommodated. The sub-assembly of the belly plate 37, vertical bar 38, upper horizontal bar 39 can be of a single size and separate shoulder straps 40 of differing radii used for small, medium, large or extra large size. The cushions 48 are of a type used to pad the interior of football and other sports helmets. Shoulder straps 40 may be made adjustable as needed.

Operation

The operation of this carrier should be apparent but will be described briefly for clarity. The carrier 36 is worn by the musician with the shoulder straps 40 positioned over the shoulders and the belly plate 37 supported against his abdomen. Pads 48 on shoulder straps 40 cushion the load of the instruments carried by carrier 36. Belly plate 38 and back bar 41 may have suitable padding over inner surfaces, as needed, to avoid discomfort from the bolts or screws used to assemble the straps to the upper horizontal bar or bolts or screws used to assemble the belly plate to the vertical bar. J-rods 46 are inserted in position and secured in place by tightening T-bolts 47. The short outer ends of the J-rods are inserted into the J-rod receptacles on the percussion instrument being carried, e.g., drums (single or array), cymbals, xylophone, marimba, or the like.

Figure 4:
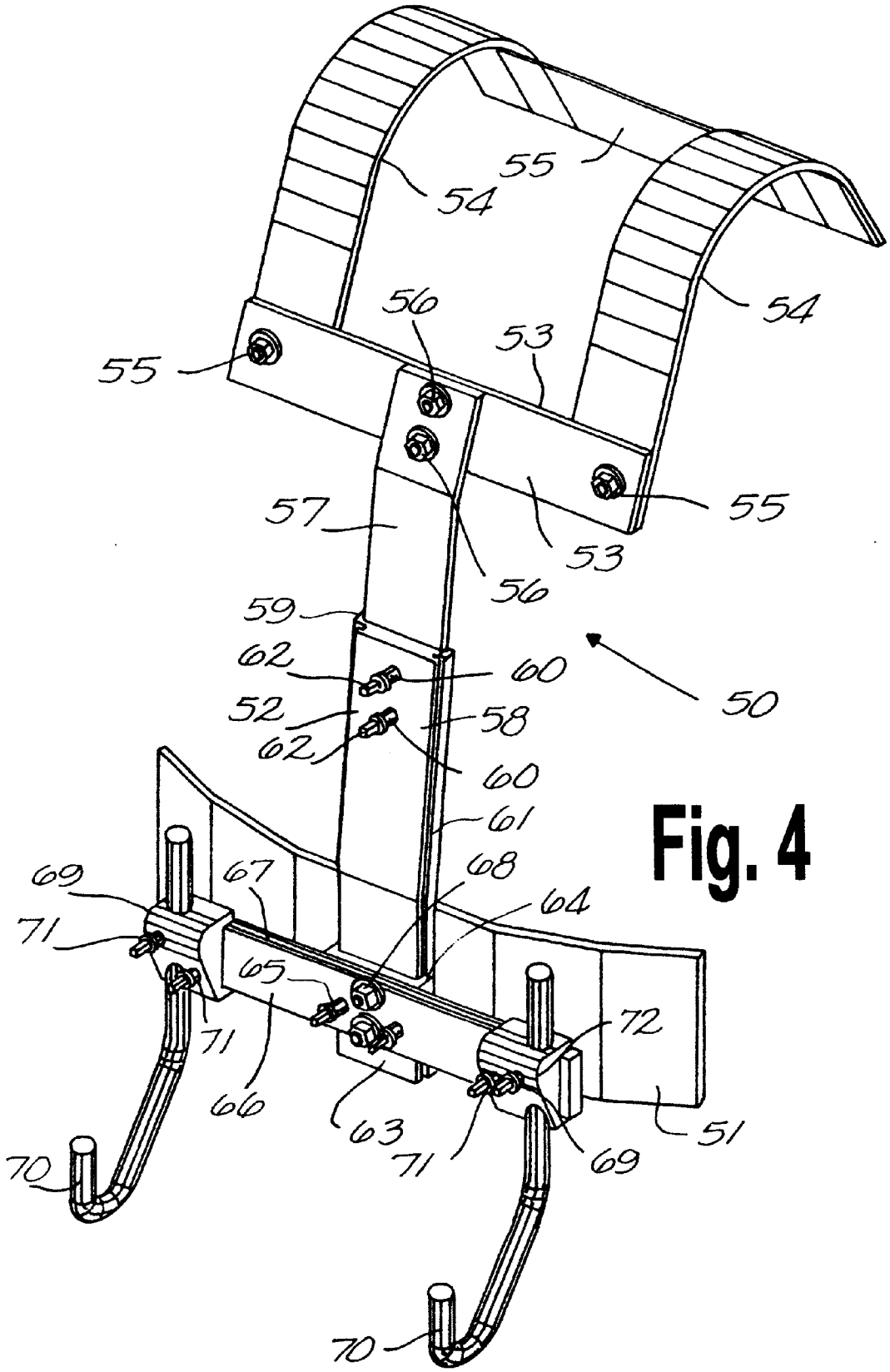
FIG. 4 is an isometric view of a novel T-bar assembly for supporting drums as in FIG. 3 containing features permitting both vertical and lateral adjustment of the points of connection to drum supporting hardware and for positioning the drums.

Universally Adjustable Marching T-Bar Support for Drums and Other Percussion Instruments Referring to FIG. 4, there is shown a T-bar-type carrier of the type shown in FIG. 3 which provides almost universal adjustment of the points of attachment and location of the percussion instruments. Pads corresponding to the pads on shoulder straps used to cushion the load of the instruments carried by the carrier in the embodiments of FIG. 3, are used in this embodiment but are not shown to avoid interfering with the showing of the various adjustment features.

Adjustable carrier 50 for percussion instruments comprises a belly plate 51, vertical bar assembly 52, upper horizontal bar 53, shoulder straps 54 and back bar 55. Back bar 55 51 is removably secured to shoulder straps 54 by screws or bolts, and upper horizontal bar 53 is removably secured to shoulder straps 54 by bolts 55. Upper horizontal bar 53 is removably secured to the upper end of vertical bar assembly 52 by bolts 56.

Vertical bar assembly 52 comprises an upper bar member 57 and lower bar member 58. Upper bar member 57 has a pair of longitudinal grooves 59 in opposite edges and lower bar member 58 has a pair of inner grooves 60 on opposite sides thereof and a pair of outer grooves 61. Bar members 57 and 58 are assembled with grooves 59 and 60 in telescoping relation for adjustable movement of the bars. Lower bar member 58 has a pair of bolts 62 with square heads, of a size for operation by a standard drum key, adjustable into and out of engagement with upper bar member 57 to secure bar assembly 52 together in any predetermined position.

Belly plate 51 is secured to a short mounting bar 63 by flat-headed bolts. Mounting bar 63 has edge grooves 64 of a size fitting grooves 61 in lower bar member 58 on which the mounting bar is assembled. Mounting bar 63 has a pair of bolts 65 with square heads, of a size for operation by a standard drum key, which are adjustable into and out of engagement with lower bar member 58 to secure the lower bar/mounting bar assembly together in any predetermined vertical location of the bell plate 51.

A J-rod receptor assembly consists of a fixed horizontal supporting bar 66, having edge grooves 67, secured on member 63 by bolts 68. J-rod-receiving brackets 69 have vertical holes sized to receive J-rods 70 as in the other embodiments. Brackets 69, however, are adjustably supported on supporting bar 66. Brackets 69 have internal grooves which fit supporting bar edge grooves 67 for sliding movement thereon and square-headed bolts 72 which set the position on supporting bar 66 and bolts 71 which secure J-rods 70 in place.

The assembly of this carrier is preferably carried out by forming two sub-assemblies and then assembling them together. Belly plate 51, suitably cushioned, is assembled on lower vertical bar 58. J-rod receptor supporting bars are secured on the mounting slide and slid into position on the lower vertical bar and fixed in position. The J-rod receptor brackets are slid into position on the supporting bar grooves and fixed in position to complete the lower sub-assembly.

The upper sub-assembly is produced by fastening the upper vertical bar to the upper horizontal bar. The upper horizontal bar is assembled to the shoulder straps and the back bar secured thereon. The cushioning is then installed on the underside of the shoulder straps and back bar which completes the sub-assembly.

The upper sub-assembly and lower sub-assembly are then assembled by fitting upper vertical bar 57 into sliding relation in lower vertical bar 58. Grooves in bar 57 fit into the grooves in bar 58 in sliding relation and the bars 57 and 58 are fixed in position by tightening bolts 62 to complete the assembly.

Operation

The operation of this carrier should be apparent but will be described briefly for clarity. The carrier 50 is worn by the musician with the shoulder straps 549 positioned over the shoulders and the belly plate 51 supported against his abdomen. Belly plate 51, back bar 55, shoulder straps 54, and upper horizontal bar 53 may have suitable padding over their inner surfaces to avoid discomfort. J-rods 70 are inserted in position and secured in place by tightening bolts 71. The short outer ends of the J-rods are inserted into the J-rod receptacles on the percussion instrument being carried, e.g., drums (single or array), cymbals, xylophone, marimba, or the like.

The carrier is universally adjustable. The positioning of the belly plate 51 is adjusted by adjusting the length of the vertical bar assembly 52 by sliding bars 57 and 58 to a desired position and re-tightening the set bolts 62. The lateral spacing of the J-rod supporting brackets 69 is adjustable by loosening bolts 71, setting the brackets to the desired position and re-tightening the bolts. J-bolts 70 are set to the desired vertical position and angular orientation by set bolts 71.

Figure 5:
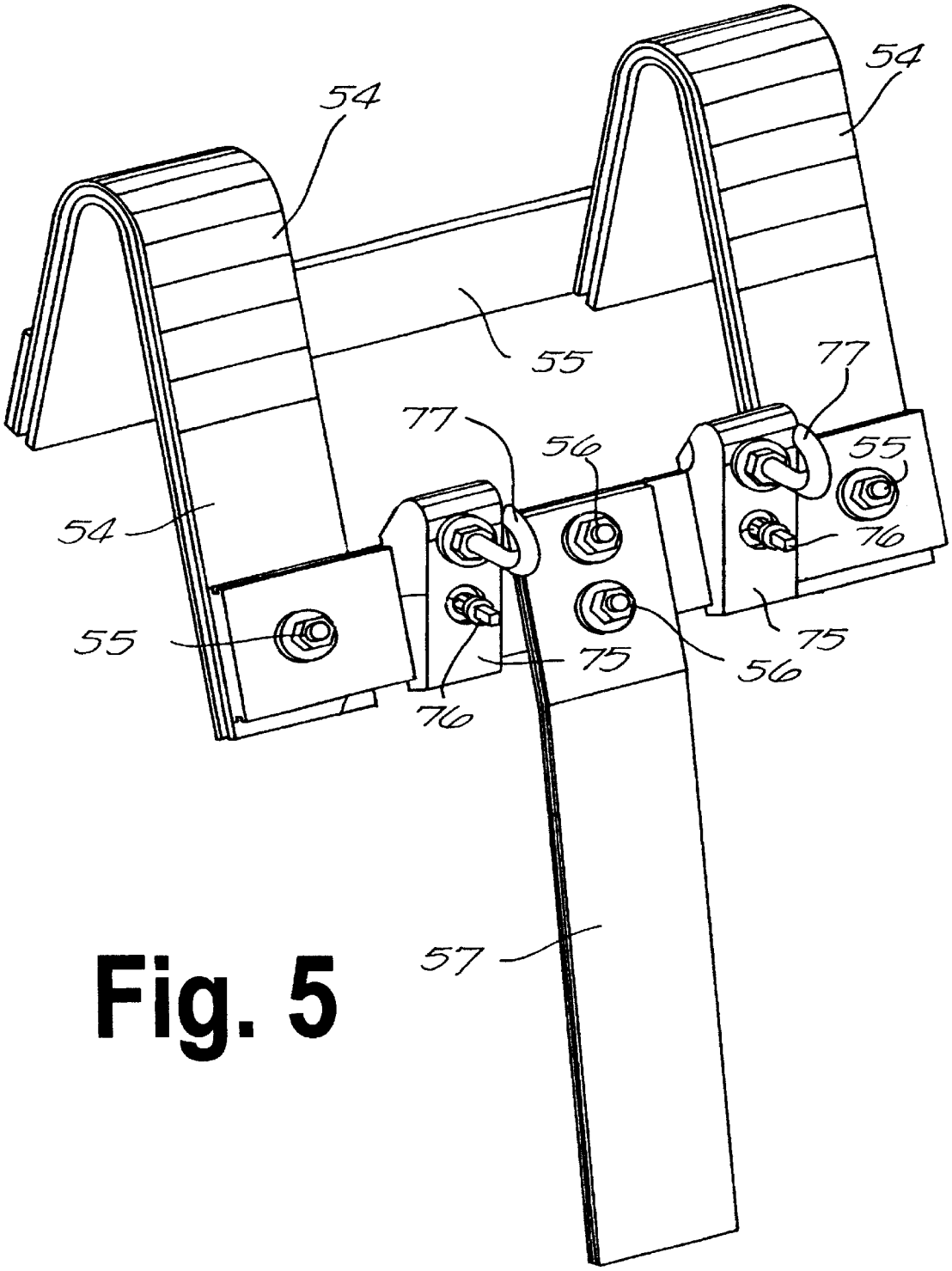
FIG. 5 is a detail isometric view of the shoulder straps, back bar, upper cross bar and upper vertical bar of the T-bar assembly shown in FIG. 4 with J-rod brackets on the upper horizontal bar.

Universally Adjustable Marching T-Bar Support for Drums and Other Percussion Instruments Referring to FIG. 5, there is shown the top sub-assembly of a T-bar-type carrier of the type shown in FIG. 4 including J-bolts and brackets for supporting the top of a bass drum. Like parts are given the same reference numerals and their description is not repeated.

In this embodiment, brackets 75 fit slidably on upper bar 53 and are secured in position by square-headed bolts 76. J-bolts 77 and supported in brackets 75.

While this invention has been described fully and completely, with special emphasis on several preferred embodiments and/or applications, it should be understood that within the scope of the appended claims, the invention may be practiced otherwise than as specifically described.

What is claimed is:

1. A shoulder supported harness assembly for supporting percussion instruments, comprising a cover member resting against the abdominal region of the wearer in use, said cover member is a vest of a light weight metal or a composite material covering the abdominal region of the wearer in use, a pair of rigid shoulder straps removably and rigidly secured to said cover member for supporting the same for substitution of shoulder straps of different size, and drum supporting hardware operatively supported on said cover member.

2. A shoulder supported harness assembly for supporting percussion instruments according to claim 1, in which:

said cover member and rigid shoulder straps are removably and rigidly secured together, and including a back bar rigidly secured between said shoulder straps for contacting the back of the wearer.

3. A shoulder supported harness assembly for supporting percussion instruments according to claim 1, including a horizontal member secured to a lower portion of said vest, a pair of receptacles supported for positioning laterally on said horizontal member, and J-rods supported in said receptacles.

4. A shoulder supported harness assembly for supporting percussion instruments according to claim 1, including a horizontal bar member secured on the lower end of said vest member, a pair of receptacles supported for positioning laterally on said horizontal bar member, and J-rods supported in said receptacles.

5. A shoulder supported harness assembly for supporting percussion instruments according to claim 1, in which said shoulder straps are formed of a rigid list metal.

6. A shoulder supported harness assembly for supporting percussion instruments according to claim 1, in which said shoulder straps and said cover member are formed of a rigid light metal, which is magnesium, aluminum or titanium.

7. A shoulder supported harness assembly for supporting percussion instruments, comprising a rigid vest resting against the upper body of the wearer in use, a pair of rigid shoulder straps removably and rigidly secured to said vest, said shoulder straps and said vest having elongated slots in one and holes in the other, bolts for securing said shoulder straps on said vest, said bolts extending through said slots and said holes and operable on tightening to fix the position of said shoulder straps on said vest to permit substitution of shoulder straps of varying sizes, drum supporting hardware operatively supported on said supporting member, and means for adjustably supporting and positioning ad drum supporting hardware.

8. A shoulder supported harness assembly for supporting percussion instruments according to claim 7, including:

a back bar removably and adjustably secured between the ends of said shoulder straps for contacting the back of the wearer.

* * * * *

UNITED STATES PATENT AND TRADEMARK OFFICE

CERTIFICATE OF CORRECTION

PATENT NO. : 6,329,583 B1
APPLICATION NO. : 09/497266
DATED : December 11, 2001
INVENTOR(S) : May It is certified that error appears in the above-identified patent and that said Letters Patent is hereby corrected as shown below:

Title page, Item (60) should be deleted and replaced with the following:

-- Related U.S. Application Data

(60) This application is a continuation-in-part of applicant's application Ser. No. 09/497,265 filed Feb. 3, 2000, now U.S. Pat. No. 6,323,407 issued Nov. 27, 2001. And is a division of applicant's application Ser. No. 08/976,999, allowed Sep. 24, 1997 now U.S. Pat. No. 6,028,257, which is a continuation-in-part of applicant's application Ser. No. 08/588,244, filed Jan. 18, 1996 now U.S. Pat. No. 5,691,492, issued Nov. 25, 1997. --

Signed and Sealed this
Fourth Day of January, 2011

David J. Kappos

David J. Kappos
*Director of the United States Patent and Trademark Office*